United States Patent [19]

Joslyn

[11] 3,946,514

[45] Mar. 30, 1976

[54] MOSAIC BLOCK TOY

[76] Inventor: John Joslyn, Bayview Ave., Sag Harbor, L.I., N.Y. 11963

[22] Filed: Oct. 4, 1974

[21] Appl. No.: 511,997

[52] U.S. Cl. ..... 46/1 R; 35/75

[51] Int. Cl.[2] ..... A63H 33/10

[58] Field of Search ..... 35/16, 27, 354, 75; 46/1 R; 273/153 S

[56] References Cited

UNITED STATES PATENTS

| | | | |
|---|---|---|---|
| 448,019 | 3/1891 | Garben | 35/75 |
| 1,268,391 | 6/1918 | Sehepmoes | 35/27 |
| 3,127,175 | 3/1964 | White | 273/153 S |

*Primary Examiner*—Hugh R. Chamblee
*Assistant Examiner*—Robert E. Cutting
*Attorney, Agent, or Firm*—Arthur T. Fattibene

[57] ABSTRACT

A mosaic block construction toy having a base member formed with a endless groove and a plurality of passageways connected in communication with the endless groove, and having a plurality of construction blocks moveably mounted within the groove and/or passageways. Each block has formed on the surface thereof indica means so that when the blocks are arranged in the passageways in a predetermined order, they combine to form a predetermined design.

1 Claim, 5 Drawing Figures

MOSAIC BLOCK TOY

PROBLEM & PRIOR ART

Heretofore various block construction toys have been conceived. However, the known construction block toys included plurality of blocks, which a child could arrange and rearrange, which were separate and discrete units. For this reason such blocks were easily scattered about the playroom which made it difficult for a parent to collect or put away after the child completed playing with them. Also, such loose blocks were easily lost and/or misplaced. Loose blocks sometimes proved hazardous in that a child would frequently use such blocks as missiles and/or such blocks if not carefully collected and put away can and did cause accidents if one inadvertently stepped on one. For these reasons the discrete block construction toys and similar discrete unit construction toys have a number of disadvantages.

OBJECTS

An object of this invention is to provide a block construction type toy in which the unit blocks are confined to a base member, but which blocks can be relatively shifted, arranged and rearranged in any given order to define a predetermined design.

Another object is to provide a block construction toy in which the surface of the blocks have formed thereon indicia wherein the blocks can be readily arranged in a predetermined order on a connected base member so that the respective indicia thereon combine to define a predetermined design.

Another object is to provide a block construction toy in which the blocks are confined in a base member in a manner whereby respective blocks can be shifted and/or rotated on the base member so that the blocks can be arranged to define a predetermined design.

BRIEF SUMMARY OF INVENTION

The foregoing objects and other features and advantages are attained in a mosaic block or construction toy comprising a rigid base member having formed thereon an endless groove having a plurality of connected passageways formed in communication with the groove. The passageways have a deadend portion which terminates adjacent a backstop. Moveably mounted in the endless groove are a series of blocks, the surface of the bocks having indicia formed thereon. The respective blocks are confined within the endless groove in a manner wherein the respective blocks can be shifted and/or rotated within the groove or passageway. The respective blocks while rendered freely moveable along the groove and passageways are connected to the base member so that they are securely connected thereto. By selective shifting and rotating the blocks to the respective passageways, the indicia formed on the surfaces of the blocks combine to define a predetermined design.

FEATURES

A feature of this invention resides in the provision wherein the respective blocks are positively retained or connected to the backing member so as to be normally inseparable therefrom.

Another feature resides in the provision in which the blocks while inseparable from its base member, are nevertheless freely moveable within the endless groove and connected passageways.

Another feature resides in the provision that the respective blocks have formed thereon indicia which when combined in a predetermined order define a predetermined design.

Another feature resides in a mosaic block construction toy in which the respective blocks are contained and which presents a child with a considerable amount of play value.

Another feature resides in a construction toy that is safe and easy to use.

Another feature resides in the provision of a block construction toy in which the respective blocks can be readily arranged and rearranged, but which are at all times connected to a base member.

Other features and advantages will become more readily apparent when considered in view of the drawings and specifications in which.

DETAILED DESCRIPTION

Figure 1:
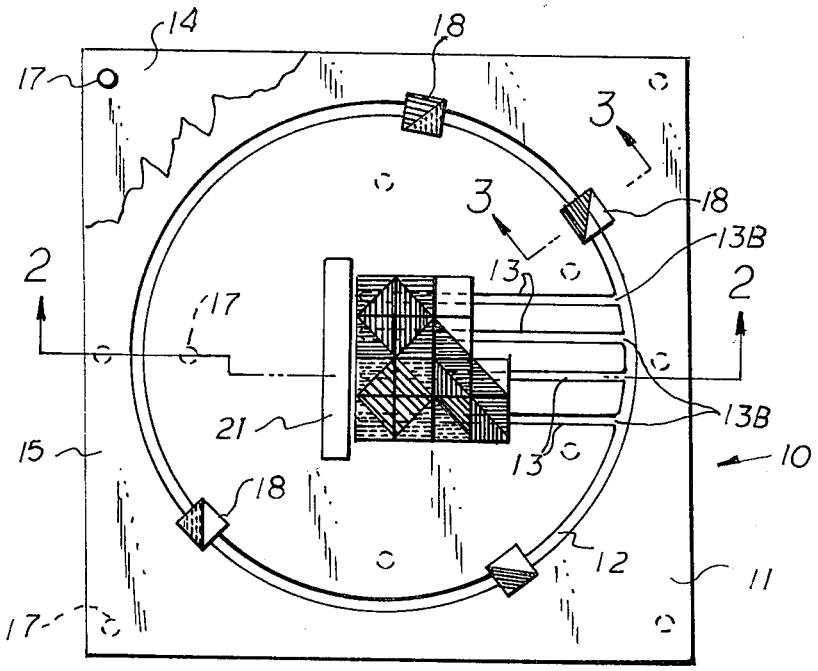
FIG. 1 is a top plan view of a mosaic or block construction toy embodying the present invention.

Referring to the drawings, there is shown a mosaic or block construction toy 10 embodying the present invention. The toy 10 comprises a base member 11 which has formed thereon an endless groove or track 12 and a plurality of connected passways or branch tracks 13. The passways or branch tracks 13 have one end connected into communication with groove or track 12. The other end of the passways or branch tracks 13 is dead ended. As best seen in FIG. 1, the respective passways are disposed in spaced apart, parallel relationship.

Figure 2:
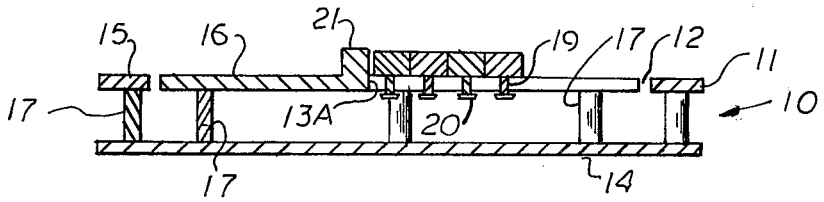
FIG. 2 is a detailed sectional view taken along line 2—2 on FIG. 1.

As best seen in FIGS. 1 and 2, the base member comprises a support plate 14 which supports an outer annular portion 15 and an inner portion 16. Spacers 17 support the inner and outer portions 15 and 16 respectively in spaced overlying relationship to the support plate 14. The passways 13 are formed in the inner portion; and the enldess groove on track 12 being formed by spacing the outer periphery 15A of the inner portion 15 from the inner periphery 15A of the outer portion 15.

Figure 3:
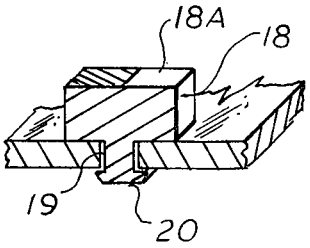
FIG. 3 is a sectional view taken along line 3—3 on FIG. 1.

Mounted within the groove or track 12 are a plurality of mosaic blocks 18. The blocks 18 are mounted so as to be freely moveable within the groove 12 and passways 13. As best seen in FIGS. 1 and 3, the surface of the blocks, e.g., the top surface 18A of each block is provided with indica means to define a specific shape, form, or color. For example, in the illustrated embodiment, the blocks may be partitioned along a diagonal and each section thereof being separately colored. Other blocks may have their upper surface formed with other patterns or shapes which may be colored and/or colored coded to define various mosaic type blocks.

Each of the respective blocks 18 so formed are freely shiftable within the grooves and passways 12 and 13. This is attained by providing each block with a depending pin or projection 19 which is adapted to extend into the groove or tracks 12 and 13. It will be noted that the pins enable the respective blocks 18 to be shifted and/or rotated within the groove or passways 12 and 13 respectively. To retain the blocks 18 to the base member at all times, the head end of the pin 19 is flared or flanged, or otherwise enlarged as indicated at 20 so as to normally prohibit the respective blocks from becoming separated from the base member 11. It will be understood that a plurality or train of blocks 18 are contained along track or groove 12. While the top surface of the respective blocks are provided with indicia means in the form of color and/or shapes, the sides of the respective blocks may also be provided with suitable indicia means.

In the play of the game, a child may create a large number of variable mosaic type designs simply by arranging selective blocks 18 along the respective passages 13. The blocks can be maintained in a squared position by providing a back stop 21 adjacent the deadend portion 13A of tracks 13. It will be understood that a child may direct any block 18 aligned in groove 12 to a given trackway 13 simply by shifting the train of blocks in groove 12 until the selected block in the train is positioned opposite the entrance 13B of the appropriate passway 13. By proper selection of blocks 18, a child can create various mosaic patterns and/or designs.

Figure 4:
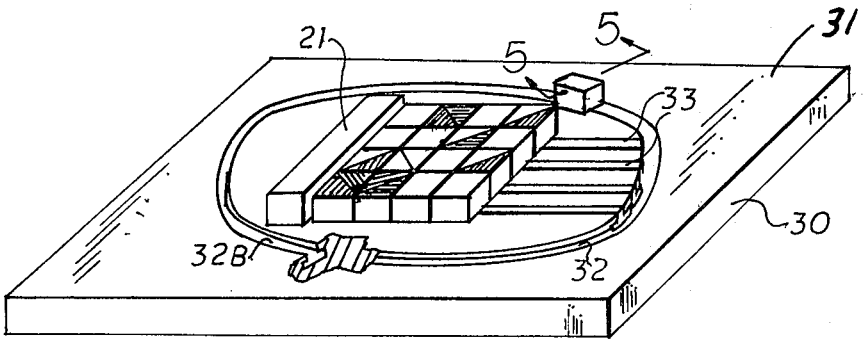
FIG. 4 is a perspective view of a modified embodiment.

FIG. 4 illustrates a modified embodiment. In this form of the invention, the base member 30 may be formed as an integral unit. In this embodiment the base member 30 comprises a unitary member having an endless groove or track 32 which is T shape in cross section. That is, the stem 32A portion of the groove 32 defines a restrictive portion which opens to the top 31 of the base member 30. The cross arm 32B of the T groove 32 is disposed internally of the base member 30. The respective passways or branch tracks 33 are similarly shaped in cross section.

Figure 5:
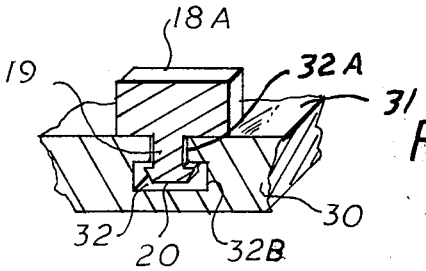
FIG. 5 is a detailed sectional of the modified construction taken along line 5—5 on FIG. 4.

As shown in FIG. 5, the enlarged head end 20 of the block 18 connecting pin 19 are force fitted into the restricted stem portion 32A of the groove or track 32 and 33 to normally position the enlarged head end 20 of the connecting pins 19 within the cross arm 32B of the T shaped grooves. In this manner the blocks 18 are normally retained within the respective T shaped grooves or tracks 32, 33. The respective blocks 18 are freely shiftable and/or rotatably retained for full rotation of 360° within the respective groove or passway. By so forming the grooves and passways, the base member may be formed as a unitary member.

While the invention has been described with respect to various embodiments thereof, it will be appreciated and understood that variations and modifications may be made without departing from the spirit or scope of the invention.

What is claimed is:

1. A mosaic block toy comprising:

a base member, means defining an endless groove formed in said base member, a plurality of passways directly connected in communication with said endless groove, whereby the directly connected passways are parallel one another, each of said passways having a dead end, a backstop disposed adjacent the dead end of said passways, a plurality of mosaic blocks, said back stop and blocks having complementary edge portions to insure initial orientation of said blocks, means connected to said blocks for containing said blocks confined to said endless groove and connected passways whereby said blocks can be shifted and rotated within both said groove and passways as they are moved along said groove and passways for changing the orientation of said blocks with respect to one another therein, indicia means formed on the surfaces of said blocks whereby said blocks may be positioned along said passways in a predetermined order whereby the indicia thereon combine to define a predetermined overall design.

* * * * *